US006133686A

United States Patent [19]

Inoue et al.

[11] Patent Number: 6,133,686

[45] Date of Patent: Oct. 17, 2000

[54] DISPLAY TUBE HAVING AN INNER CURVATURE COMPENSATING FOR FLOATING DISTORTION

[75] Inventors: Akira Inoue; Yasuo Iwasaki; Minoru Hojo, all of Tokyo, Japan

[73] Assignee: Mitsubishi Denki Kabushiki Kaisha, Tokyo, Japan

[21] Appl. No.: 09/026,325

[22] Filed: Feb. 19, 1998

[30] Foreign Application Priority Data

| | | | |
|---|---|---|---|
| Feb. 24, 1997 | [JP] | Japan | 9-039020 |
| Aug. 29, 1997 | [JP] | Japan | 9-234586 |
| Nov. 7, 1997 | [JP] | Japan | 9-305914 |

[51] Int. Cl.[7] ..... H01J 31/00; H01J 29/10; H01J 61/30; H01K 1/28

[52] U.S. Cl. ..... 313/477 R; 313/461; 220/2.1 A

[58] Field of Search ..... 313/407–408, 313/461, 474, 476, 477 R, 479, 482; 220/2.1 R, 2.1 A, 2.3 R, 2.3 A; 358/242, 246, 243, 217, 250, 251–53

[56] References Cited

U.S. PATENT DOCUMENTS

| | | | |
|---|---|---|---|
| 3,126,495 | 3/1964 | Kurtin | 313/461 X |
| 4,537,322 | 8/1985 | Okada et al. | 313/477 R X |
| 4,985,658 | 1/1991 | Canevazzi | 313/477 R |
| 5,107,999 | 4/1992 | Canevazzi | 313/461 X |
| 5,155,410 | 10/1992 | Wakasono et al. | 313/408 X |
| 5,386,174 | 1/1995 | Ishii | 313/408 |
| 5,536,995 | 7/1996 | Sugawara et al. . | |
| 5,602,443 | 2/1997 | Igeta et al. . | |
| 5,814,933 | 9/1998 | Iwata et al. | 313/477 R |

FOREIGN PATENT DOCUMENTS

| | | |
|---|---|---|
| 0825632A1 | 2/1998 | European Pat. Off. . |
| 2-148544 | 6/1990 | Japan . |
| 7-142012 | 6/1995 | Japan . |
| WO 9611491 | 4/1996 | WIPO . |

OTHER PUBLICATIONS

Patent Abstract of Japan, vol. 018, No. 252 (E–1547), May 13, 1994, and JP 06 036710 A (Hitachi Ltd.), Publication No. 06036710, Published Oct. 2, 1994, Application No. 04193657 (Abstract).

*Primary Examiner*—Vip Patel
*Assistant Examiner*—Mack Haynes

[57] ABSTRACT

A color cathode ray tube panel has a glass face portion including a substantially flat outer surface facing a viewer and an inner surface on which a phosphor screen is coated. The inner surface is concavely curved with a radius of curvature $R_x$ in a direction of a horizontal axis of the cathode ray tube, and the following conditions are satisfied:

$$R_x \le \frac{\left(\frac{W_h}{2}\right)^2 + \Delta t_h^2}{2 * \Delta t_h}$$

$$\Delta t_h = t * \left[1 - \frac{\cos^2\theta_{2h}}{n_1 - \frac{1}{n_1} * \sin^2\theta_{2h}}\right]$$

$$\theta_{2h} = \tan^{-1}\left(\frac{W_h}{2 * L}\right)$$

where $W_h$ denotes a horizontal width of an effective area of picture in the face portion, L denotes an optimum viewing distance, $n_1$ denotes a refractive index of the face portion, and t denotes a thickness of the face portion at its center.

7 Claims, 10 Drawing Sheets

| GLASS MATERIAL | TRANSMITTANCE % (10.16mm, 546nm) |
|---|---|
| A | 90 |
| B | 86 |
| C | 80 |
| D | 73 |
| E | 57 |
| F | 46 |

DISPLAY TUBE HAVING AN INNER CURVATURE COMPENSATING FOR FLOATING DISTORTION

BACKGROUND OF THE INVENTION

The present invention relates to a face panel of a color cathode ray tube.

FIG. 8 shows cross sections of a conventional color cathode ray tube (CRT). An upper half of the figure Is the cross section in a direction of a vertical axis V (referred to as a vertical cross section), and a lower half of the figure is the cross section in a direction of a horizontal axis H (referred to as a horizontal cross section). As shown in FIG. 8, the conventional color CRT has a face panel 1 (referred to as a panel 1), and a funnel 2 which constitutes an envelope of the CRT together with the panel 1. The color CRT also has a phosphor screen 3 comprising red, green, and blue phosphor dots orderly arranged and formed on an inner surface 10*a* of a face portion 10 of the panel 1, an electron gun 4 for emitting an electron beam 5, a deflection yoke 6 for electromagnetically deflecting the electron beam 5, and a tensioned shadow-mask 7 that functions as a color selection electrode. A perspective view of the tensioned shadow-mask 7 is schematically shown in FIG. 9.

Further, FIG. 10A shows cross sections of another conventional color CRT. An upper half of the figure is the vertical cross section, and a lower half of the figure is the horizontal cross section. FIG. 10B shows a perspective view of the color CRT of FIG. 10A. The color CRT shown in FIGS. 10A and 10B uses a pressed shadow-mask 77 having a surface curved in directions of vertical, horizontal and diagonal axes V, H and D. A perspective view of pressed the shadow-mask 77 is schematically shown in FIG. 11.

A high vacuum is maintained within the color CRTs of FIG. 8 and FIG. 10A by the envelope comprising the panel 1 and the funnel 2. When the electron beam 5 emitted from the electron gun 4 strikes on the phosphor screen 3 formed on the inner surface 10*a* of the face portion 10 of the panel 1, to which a high voltage is applied, the phosphor screen 3 emits light. At the same time, the electron beam 5 is deflected vertically and horizontally by a deflecting magnetic field generated by the deflection yoke 6, and forms on the phosphor screen 3 an image display area referred to as a raster. When red, green, and blue light from the image display area of the phosphor screen 3, intensity of which depends on intensity of the electron beam 5 impinging on the phosphor screen 3, is observed from an outside of the panel 1, an image is recognized.

The shadow-mask 7 (77) has a very large number of orderly arranged holes. The electron beam 5 passes through the hole so that it geometrically impinges on the red, green, or blue phosphor dot on the phosphor screen 3 at a predetermined location to perform accurate color selection. Since the color selection in the shadow-mask-type color CRT is geometrically performed, as has been described above, a predetermined positional relationship among the panel 1, the electron gun 4, and the shadow-mask 7 (77) must be accurately maintained.

In the conventional color CRTs of FIG. 8 and FIG. 10A formed as described above, the outer and inner surfaces 10*b* and 10*a* of the face portion 10 of the panel 1 on which the image display area is formed are curved so as to be convex toward the outside (that is, the outer surface 10*b* is convex and the inner surface 10*a* is concave) in order to resist the atmospheric pressure from the outside and maintain a high vacuum inside the color CRT. This, however, has caused several problems including the following: The displayed image is perceived convexly, the image is distorted when viewed obliquely, and portions of the image near the edges are hidden.

In order to solve these problems, a color CRT in which the image display area of the face portion of the panel is flat on its inner and outer surfaces was developed. This color CRT, however, requires a flat shadow-mask in order to keep accurately a predetermined positional relationship between the panel and the shadow-mask for the color selection, and such shadow-mask is very difficult to form. Due to the difference between the refractive index of the atmosphere and that of glass material of the panel, an image is perceived as being floated at the edges of the screen, that is, a displayed image is perceived concavely.

SUMMARY OF THE INVENTION

It is an object of the present invention to provide a color CRT panel that can display an image which is perceived as being flat, has uniform brightness, that is, little difference between the brightness of the image at the center and that at the edges, and has little contrast deterioration.

A color CRT panel according to one aspect of the present invention comprises a glass face portion including a substantially flat outer surface facing a viewer and an inner surface on which a phosphor screen is coated. The inner surface is concavely curved with a radius of curvature $R_x$ in a direction of a horizontal axis of the cathode ray tube, and the following conditions are satisfied:

$$R_x \le \frac{\left(\frac{W_h}{2}\right)^2 + \Delta t_h^2}{2 * \Delta t_h}$$

$$\Delta t_h = t * \left[1 - \frac{\cos^2\theta_{2h}}{n_1 - \frac{1}{n_1} * \sin^2\theta_{2h}}\right]$$

$$\theta_{2h} = \tan^{-1}\left(\frac{W_h}{2 * L}\right)$$

where $W_h$ denotes a horizontal width of an effective area of picture in the face portion, L denotes an optimum viewing distance, $n_1$ denotes a refractive index of the face portion, and t denotes a thickness of the face portion at a center thereof.

In this panel, a cross section of the inner surface in a direction of a vertical axis perpendicular to the horizontal axis is straight.

Further, a color CRT panel according to another aspect of the present invention comprises a glass face portion including a substantially flat outer surface facing a viewer and an inner surface on which a phosphor screen is coated.

The inner surface is concavely curved with a radius of curvature $R_x$ in a direction of a horizontal axis of the cathode ray tube, and the following conditions are satisfied:

$$R_x \le \frac{\left(\frac{W_h}{2}\right)^2 + \Delta t_h^2}{2 * \Delta t_h}$$

$$\Delta t_h = t * \left[1 - \frac{\cos^2\theta_{2h}}{n_1 - \frac{1}{n_1} * \sin^2\theta_{2h}}\right]$$

-continued $$\theta_{2h} = \tan^{-1}\left(\frac{W_h}{2 * L}\right)$$

where $W_h$ denotes a horizontal width of an effective area of picture in the face portion, L denotes an optimum viewing distance, $n_1$ denotes a refractive index of the face portion, and t denotes a thickness of the face portion at a center thereof; the inner surface is concavely curved with a radius of curvature $R_y$ in a direction of a vertical axis perpendicular to the horizontal axis, and the following conditions are satisfied:

$$R_y \leq \frac{\left(\frac{W_v}{2}\right)^2 + \Delta t_v^2}{2 * \Delta t_v}$$

$$\Delta t_v = t * \left[1 - \frac{\cos^2\theta_{2v}}{n_1 - \frac{1}{n_1} * \sin^2\theta_{2v}}\right]$$

$$\theta_{2v} = \tan^{-1}\left(\frac{W_v}{2 * L}\right)$$

where $W_v$ denotes a vertical width of the effective area of picture; and the inner surface is concavely curved with a radius of curvature $R_d$ in a direction of a diagonal axis of the cathode ray tube, and the following conditions are satisfied:

$$R_d \leq \frac{\left(\frac{W_d}{2}\right)^2 + \Delta t_d^2}{2 * \Delta t_d}$$

$$\Delta t_d = t * \left[1 - \frac{\cos^2\theta_{2d}}{n_1 - \frac{1}{n_1} * \sin^2\theta_{2d}}\right]$$

$$\theta_{2d} = \tan^{-1}\left(\frac{W_d}{2 * L}\right)$$

where $W_d$ denotes a diagonal width of the effective area of picture.

Furthermore, the face portion may include compressive stress layers each forming the outer surface and the inner surface.

Also, it is desirable that a condition $1000\,[\text{psi}] \leqq \sigma_c \leqq 2000\,[\text{psi}]$ may be satisfied, where $\sigma_c$ denotes a value of stress generated in the compressive stress layers.

Further, a transmittance of glass material of the face portion ranges as indicated below:

$$\frac{(1-R)^2 * e^{kt_1} * 100}{(1-R)^2 * e^{kt_0} * 100} \geq 0.85$$

where R denotes a reflectivity of the glass material, k denotes an absorption coefficient of the glass material, $t_0$ denotes a thickness of the face portion at a center thereof, and $t_1$ denotes a thickness of the face portion at the edges thereof.

Furthermore, the color CRT panel may further comprise a surface treatment film having a transmittance ranging from 50% to 90% on the face portion using such glass material that offers a transmittance of 60% or higher, so that an overall transmittance of the face portion and the surface treatment film ranges from 30% to 60%.

BRIEF DESCRIPTION OF THE DRAWINGS

The present invention will become more fully understood from the detailed description given hereinbelow and the accompanying drawings which are given by way of illustration only, and wherein.

DETAILED DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

First Embodiment

Figure 1A:
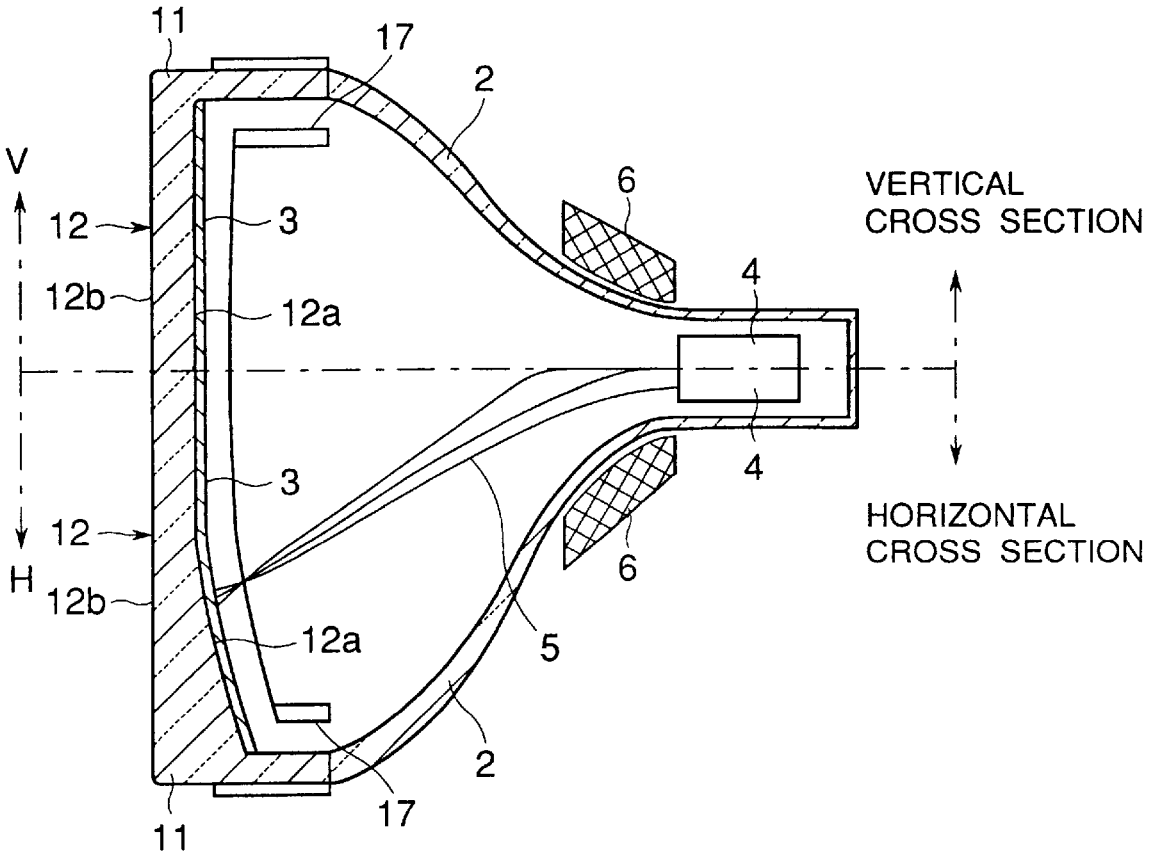
FIG. 1A and FIG. 1B shows cross sections and a perspective view of a color CRT using a color CRT panel according to a first embodiment of the present invention.
Figure 1B:
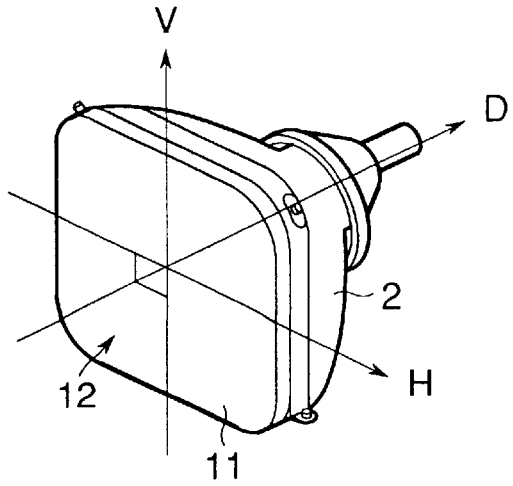

FIG. 1A shows cross sections of a color CRT using a panel according to a first embodiment of the present invention, and FIG. 1B is a perspective view of the color CRT of FIG. 1A. An upper half of FIG. 1A is the cross section in a direction of a vertical axis V (referred to as a vertical cross section), and a lower half of FIG. 1A is the cross section in a direction of a horizontal axis H (referred to as a horizontal cross section) perpendicular to the vertical axis V.

As shown in FIG. 1A, the panel 11 of the color CRT according to the first embodiment has a glass face portion 12 including a substantially flat outer surface 12*b* facing a viewer and an inner surface 12*a* on which a phosphor screen 3 is coated. A cross section of the inner surface 12*a* taken along the direction of the vertical axis V is straight, and a cross section of the inner surface 12*a* taken along the direction of the horizontal axis H is concavely curved with a predetermined radius of curvature $R_x$. The panel 11 constitutes an envelope of the color CRT together with a funnel 2.

The color CRT is provided with the phosphor screen 3 on the inner surface 12*a* of the face portion 12 of the panel 11. The phosphor screen 3 includes red, green, and blue phosphor dots orderly arranged.

The color CRT is also provided with an electron gun 4 in the funnel 2 for emitting the electron beam 5, and a deflection yoke 6 around a neck portion of the funnel 2 for electromagnetically deflecting the electron beam 5.

The color CRT is further provided with a tensioned shadow-mask 17 which faces the inner surface 12*a* of the panel 11 in the envelope and functions as a color selection electrode.

The operation of the color CRT will next be described. A high vacuum is maintained in the color CRT by the envelope comprising the panel 11 and the funnel 2. When the electron beam 5 emitted from the electron gun 4 strikes on the phosphor screen 3 formed on the inner surface 12*a* of the face portion 12 of the panel 11, to which a high voltage is applied, the phosphor screen 3 emits light. In addition, the electron beam 5 is deflected vertically and horizontally by a deflecting magnetic field generated by the deflection yoke 6 and forms an image display area referred to as a raster on the phosphor screen 3. When red, green, and blue light from the image display area of the phosphor screen 3, intensity of which depends on intensity of the electron beam 5 impinging on the phosphor screen, is observed from the outside of the panel 1, an image is recognized.

The tensioned shadow-mask 17 has a very large number of orderly arranged holes. The electron beam 5 passes through the hole so that it geometrically hits the red, green, or blue phosphor dot of the phosphor screen 3 at a predetermined location to perform accurate color selection. Since the color selection in the shadow-mask-type color CRT is geometrically performed, as has been described above, a predetermined positional relationship among the panel 11, the electron gun 4, and the shadow-mask 7 must be accurately maintained.

The function of the panel 11 having the face portion 12 comprising the flat outer surface 12*b* and the inner surface 12*a* concavely curved with the predetermined radius of curvature $R_x$ will next be described. Light advances straight in a homogenous medium. However, when light encounters a boundary between two different mediums, part of the light is reflected by the boundary, and the remaining part of the light is refracted and passes through the different medium. The same phenomenon occurs when an image displayed on the color CRT is observed. Due to the difference between the refractive index of the atmosphere and that of glass, the displayed image is generally perceived as being floated near the edges of the screen.

Figure 2:
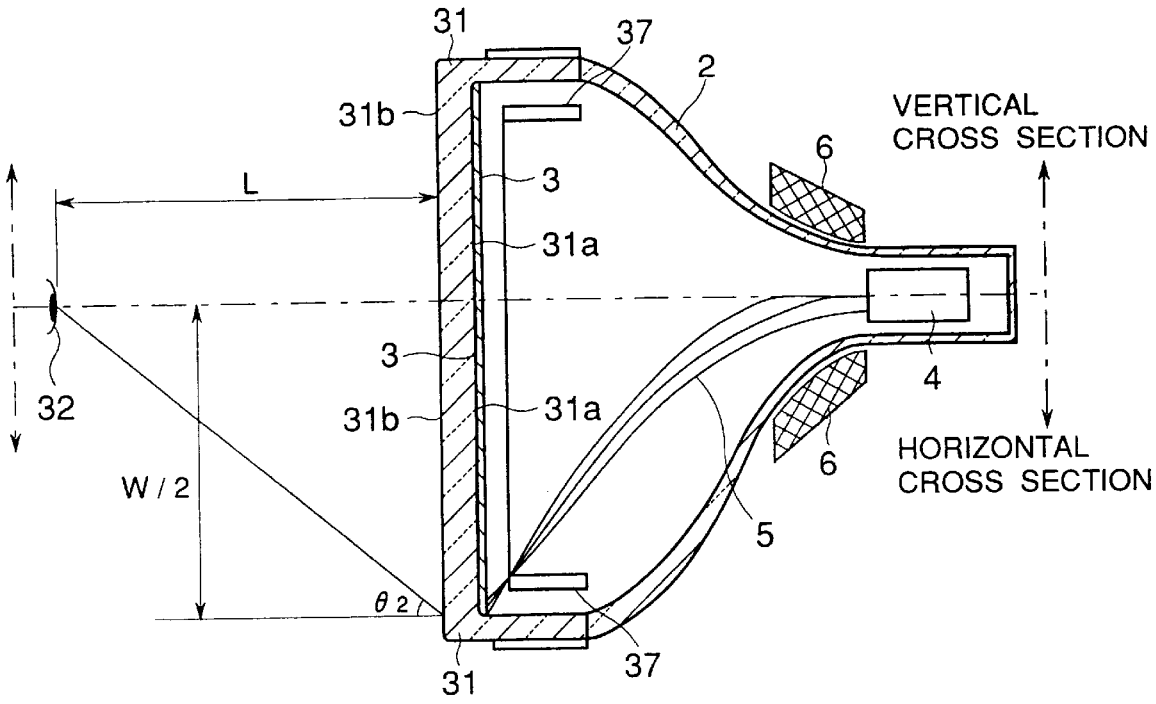
FIG.2 CONVENTIONAL ART
FIG. 2 shows cross sections of a color CRT with flat inner and outer surfaces for explaining a floating distance (floating distortion) of an image.
Figure 3:
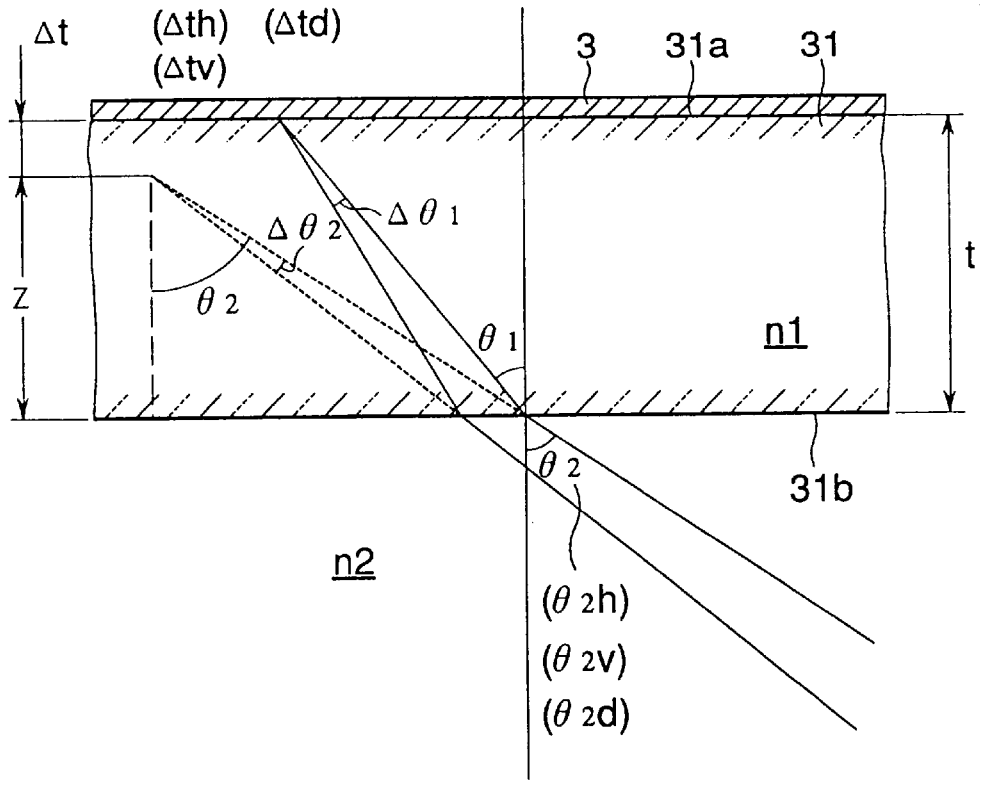
FIG. 3 is a diagram for explaining the floating distance Δt of the image on the panel of the color CRT shown in FIG. 2.

With reference to FIG. 2 and FIG. 3, a phenomenon occurring in a CRT being actually used, which comprises a panel 31 having flat inner and outer surfaces 31*a* and 31*b* of the face portion and a flat shadow-mask 37, will next be described. As illustrated in FIG. 2 and FIG. 3, light emitted from an image produced on the phosphor screen 3 advances straight in the glass of the panel 31 (a refractive index $n_1$) until it encounters the boundary (i.e., the outer surface 31*b*) between the panel 31 and the atmosphere (a refractive index $n_2$). The light is refracted at the boundary and goes straight in the atmosphere to an eye 32 of a viewer, and then the image is recognized. The incident angle $\theta_1$ of the light from the image at the boundary between the atmosphere and the glass of the panel 11 depends on a position of the eye 32 of the viewer and a position on the display surface of the color CRT (especially a distance between the center and the edge). Accordingly, an angle $\theta_2$ of refraction varies according to the positions, causing the displayed image to be perceived as being floated near the edges of the screen.

In FIG. 3, $n_1$ denotes the refractive index of the glass of the panel 31, $n_2$ denotes the refractive index of the atmosphere, $\theta_1$ denotes an incident angle of the light advancing from the phosphor screen 3 through the panel 31 to the atmosphere at a point on the boundary, and $\theta_2$ (in the first embodiment, $\theta_2$ is expressed as $\theta_{2h}$, and in the fifth embodiment described below, $\theta_2$ is expressed as $\theta_{2h}$, $\theta_{2v}$ or $\theta_{2d}$) denotes an angle of refraction. Also, t denotes a thickness of the panel 31, $\Delta t$ (in the first embodiment, $\Delta t$ is expressed as $\Delta t_h$, and in the fifth embodiment described below, $\Delta t$ is expressed as $\Delta t_h$, $\Delta t_v$ or $\Delta t_d$) denotes a floating distance (or floating distortion) at the edges of the screen, and z denotes a depth of the image perceived by the viewer.

Referring to FIG. 2 and FIG. 3, the following relationship is obtained.

$$z * \tan\theta_2 = x_1$$

$$z * \Delta\theta_2 * \frac{1}{\cos^2\theta_2} = \Delta x_1$$

$$z = \frac{\Delta x_1}{\Delta\theta_2}\cos^2\theta_2 = -\frac{1}{\Delta\theta_2}\cos^2\theta_2\frac{x_1}{\cos\theta_1\sin\theta_1}\Delta\theta_1$$

On the other hand, $$n_1\sin\theta_1 = n_2\sin\theta_2\ n_2 = 1$$

Accordingly, $$z = \frac{1}{n_1}\frac{1+\cos^2\theta_2}{\sin^2\theta_2}x_1 = \frac{t}{n_1}\frac{\cos^2\theta_2}{1-\left(\frac{1}{n_1}*\sin\theta_2\right)^2}$$

Therefore, the following relationship is obtained:

$$\Delta t = t - z = t*\left(1-\frac{1}{n_1}\frac{\cos^2\theta_2}{1-\left(\frac{1}{n_1}*\sin\theta_2\right)^2}\right) = t*\left(1-\frac{\cos^2\theta_2}{n_1-\frac{1}{n_1}*\sin^2\theta_2}\right)$$

Using this relationship, the floating distance $\Delta t_h$ at each location of the screen (for example, at each location on the horizontal axis) of the color CRT panel 11 of FIG. 1A is calculated. The inner surface 12*a* of the face portion 12 is formed so as to have the horizontal radius of curvature $R_x$ calculated by the floating distance $\Delta t_h$ at each location of the screen. In other words, the horizontal radius of curvature $R_x$ of the inner surface 12*a* of the face portion 12 is determined in accordance with the floating distance $\Delta t_h$ at each location of the screen. The inner surface 12*a* of the face portion 12 is formed to be concave in the direction of the horizontal axis H (so that the distance between the inner surface 12*a* and outer surface 12*b* of the panel 11 increases as it goes closer to the edge) in such a way that the produced image is not perceived as being concave but as being visually flat.

Because human eyes are horizontally aligned, a depth is perceived by processing mainly horizontal information and it is hard to obtain the information of depth from vertical information. So, the floating distance in a vertical direction gives little effect on the perceived flatness of the image. Accordingly, with the color CRT having the shadow-mask 17 tensioned in the vertical direction, the floating caused by the vertical flatness of the inner surface 12*a* of the face portion 12 of the panel 11 is hard to be perceived. Due to the above-mentioned function, by forming the inner surface 12*a* to have the curvature only in the horizontal direction, as shown in FIG. 1, the displayed image is visually perceived as being flat.

When a color CRT of which the effective area of picture has a horizontal width $W_h$ is viewed at a distance L in its actual use status, as shown in FIG. 2, the floating distance $\Delta t_h$ at the edges of the screen of the color CRT is expressed as indicated below:

$$\theta_{2h} = \tan^{-1}\left(\frac{W_h}{2*L}\right)$$

$$\Delta t_h = t*\left[1 - \frac{\cos^2\theta_{2h}}{n_1 - \frac{1}{n_1}*\sin^2\theta_{2h}}\right]$$

Accordingly, when the floating distance $\Delta t_h$ in the first embodiment is compensated for by setting the radius of curvature $R_x$ of the inner surface 12*a* of the panel 11 in the direction of the horizontal axis H shown in FIG. 1 as indicated below (so that the distance between the inner surface 12*a* of the panel 11 and the outer surface 12*b* of the panel 11 increases as it goes closer to the edges), the image is not perceived as being concave even if the face portion 12 of the panel 11 has the flat outer surface 12*b*. As a result, the produced image is visually perceived as being flat.

The horizontal radius of curvature $R_x$ of the inner surface 12*a* of the face portion 12 is expressed as the following approximation so that the produced image is perceived as being flat:

$$R_x = \frac{\left(\frac{W_h}{2}\right)^2 + \Delta t_h^2}{2*\Delta t_h}$$

However, since the image surface of the conventional CRT is convexly curved, the convexly curved image may often be preferred. Accordingly, it is desirable that the following conditions are satisfied:

$$R_x \leq \frac{\left(\frac{W_h}{2}\right)^2 + \Delta t_h^2}{2*\Delta t_h}$$

$$\Delta t_h = t*\left[1 - \frac{\cos^2\theta_{2h}}{n_1 - \frac{1}{n_1}*\sin^2\theta_{2h}}\right]$$

$$\theta_{2h} = \tan^{-1}\left(\frac{W_h}{2*L}\right)$$

where t denotes the thickness of the glass at the center of the screen.

The standard optimum viewing distance L used for the color CRTs is generally up to about 500 [mm] even when they are used as display monitors. The radius of curvature $R_x$ of the inner surface 12*a* of the face portion 12 of the panel 11 in the direction of the horizontal axis H should be set as indicated below:

$$R_x \leq \frac{\left(\frac{W_h}{2}\right)^2 + \Delta t_h^2}{2*\Delta t_h}$$

-continued $$\Delta t_h = t*\left[1 - \frac{\cos^2\theta_{2h}}{n_1 - \frac{1}{n_1}*\sin^2\theta_{2h}}\right]$$

$$\theta_{2h} = \tan^{-1}\left(\frac{W_h}{2*500}\right)$$

The optimum viewing distance L for the color CRTs used in general televisions sets is about 5*h, where h is the screen height (vertical width of the effective area of picture). Accordingly, the image can be perceived as being flat by setting $R_x$ approximately as indicated below:

$$R_x \leq \frac{\left(\frac{W_h}{2}\right)^2 + \Delta t_h^2}{2*\Delta t_h}$$

$$\Delta t_h = t*\left[1 - \frac{\cos^2\theta_{2h}}{n_1 - \frac{1}{n_1}*\sin^2\theta_{2h}}\right]$$

$$\theta_{2h} = \tan^{-1}\left(\frac{W_h}{2*5*h}\right)$$

With the panel 11 having a geometrically flat outer surface 12*b* of the face portion 12 and an inner surface 12*a* of the face portion 12 curved with such radius of curvature calculated to produce an image perceived as being flat, allowing for the difference between the refractive index of the atmosphere and that of the panel glass, an image that is perceived as being really flat can be displayed.

Second Embodiment

A color CRT panel according to a second embodiment of the present invention is the same as that according to the first embodiment with the exception that compressive stress layers are formed under the outer and inner surfaces 12*b* and 12*a* of the face portion 12 of the panel 11.

Figure 4:
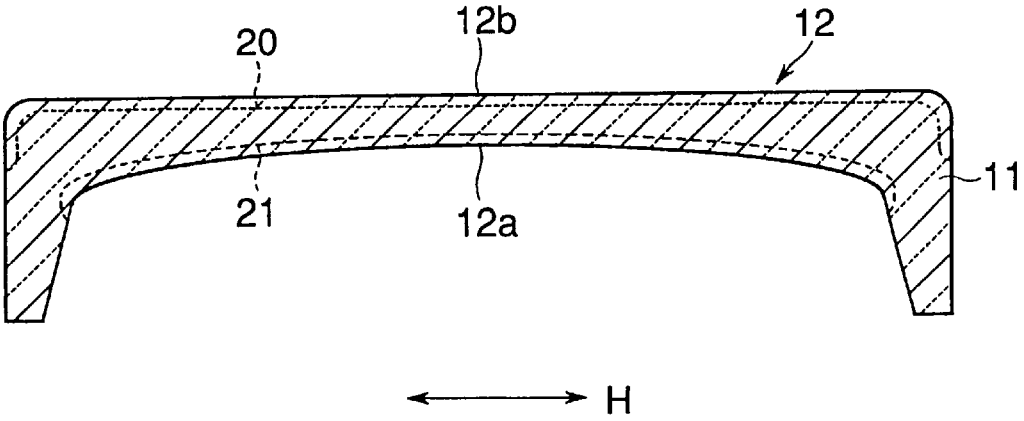
FIG. 4 is a cross section of the color CRT panel taken along a direction of the horizontal axis according to a second embodiment of the present invention.

FIG. 4 shows a horizontal cross section showing the panel 11 of the second embodiment. As shown in FIG. 4 by the dotted lines, the compressive stress layers 20 and 21 are formed respectively under the outer and inner surfaces 12*b* and 12*a* of the face portion 12 of the panel 11. The thickness of the compressive stress layers 20 and 21 is not less than $t_c/10$, where $t_c$ denotes a thickness of the face portion 12 of the panel 11 at the center.

The compressive stress layers 20 and 21 are formed by press-forming the panel 11 from molten glass and cooling it slowly in an annealing furnace so as to be physically reinforced. Magnitude of stress generated by this process depends on a time needed to gradually lower a temperature of the surfaces of the panel 11 from the annealing temperature to the strain point. As a cooling rate increases, a difference between surface shrinkage and central shrinkage increases, increasing the compressive stress on the surfaces after the cooling process. The compressive stress layers 20 and 21 enhances mechanical strength of the surfaces of the panel 11. Actual implosion resistance tests and the like have proved that if a stress value $\sigma_c$ is below 1000 [psi], the compressive stress layers 20 and 21 does not contribute physical reinforcement, while if the stress value $\sigma_c$ exceeds 2000 [psi], the glass surface of the panel 11 is flaked off when it receives a mechanical impact. Therefore, a desired range of $\sigma_c$ is:

$$1000[\text{psi}] \leqq \sigma_c \leqq 2000[\text{psi}]$$

In general, a glass bulb for a CRT is used as a vacuum vessel. The atmospheric pressure applied to the outer surface of the bulb therefore generates stress. The glass bulb is not spherical but has an asymmetrical structure, which results in comparatively wide areas of compressive stress and tensile stress. It is well known that a local crack or failure made by a mechanical impact is instantly extended to free the stored strain energy, resulting in implosion. The panel 11 of which face portion has the flat outer surface 12*b* has lower resistance to the mechanical impact. The panel 11 of which face portion has the flat outer surface 12*b*, however, can maintain predetermined mechanical strength when the compressive stress layers 20 and 21 for the physical reinforcement are provided as in the second embodiment.

Table 1 indicating an effect of the compressive stress layers 20 and 21 is shown below.

TABLE 1

| | Sample 1 | Sample 2 | Sample 3 | Sample 4 |
|---|---|---|---|---|
| CRT size [cm] | 41 | 50 | 41 | 50 |
| Radius of curvature of the outer surface [mm] | infinite | 50000 | infinite | 50000 |
| Radius of curvature of the inner surface [mm] | 2300 | 2500 | 2300 | 2500 |
| Thickness at the center [mm] | 12 | 14 | 12 | 14 |
| Compressive stress at the center [psi] | — | — | 1100 | 1250 |
| Rejection rate in implosion resistance test | 6/20 | 12/20 | 0/20 | 2/20 |

Table 1 indicates data of the rejection rate in the implosion resistance test regarding samples without physical reinforcement (Sample 1 and Sample 2) and samples with physical reinforcement (Sample 3 and Sample 4). As defined in the UL Safety Standard in the U.S.A., the glass panels of CRTs were struck by a steel ball on the face portion with an energy of 7 [J], and the amount and sizes of glass splinters and the like were measured to determine whether the glass panels have sufficient safety.

Sample 1 is a glass bulb for 41-cm color CRT using a panel in which the compressive stress layers 20 and 21 are not formed. The face portion of the panel has a flat outer surface and a cylindrical inner surface of which the radius of curvature $R_x$ in the direction of the horizontal axis is 2300 [mm].

Sample 2 is a glass bulb for 50-cm color CRT using a panel in which the compressive stress layers 20 and 21 are not formed. The face portion of the panel has an approximately flat outer surface (R=50000 [mm]) and a cylindrical inner surface of which the radius of curvature $R_x$ in the direction of the horizontal axis is 2500 [mm].

Sample 3 is a glass bulb for 41-cm color CRT using a panel in which the compressive stress layers 20 and 21 are formed. The face portion of the panel has a flat outer surface and a cylindrical inner surface of which the radius of curvature $R_x$ in the direction of the horizontal axis is 2300 [mm]. The stress value of the compressive stress layers 20 and 21 is 1100 [psi] and is almost uniform throughout the effective area of picture. The compressive stress layers 20 and 21 are about 2 [mm] thick, which is 1/10 or greater of the thickness of the panel at the center. The implosion resistance tests have proved that Sample 3 has a higher resistance to impact, due to the presence of the compressive stress layers 20 and 21, and a lower rejection rate, in comparison with Sample 1 which is the panel of the same shape.

Sample 4 is a glass bulb for 50-cm color CRT using a panel in which the compressive stress layers 20 and 21 are formed. The face portion of the panel has an approximately flat outer surface (R=50000 [mm]) and a cylindrical inner surface of which the radius of curvature $R_x$ in the direction of the horizontal axis is 2500 [mm]. The stress value of the compressive stress layers 20 and 21 is 1250 [psi] and is almost uniform throughout the effective area of picture. The compressive stress layers 20 and 21 are about 2.5 [mm] thick, which is 1/10 or greater of the thickness of the panel at the center. The implosion resistance tests have proved that sample 4 has a higher resistance to impact, due to the presence of the compressive stress layers 20 and 21, and a lower rejection rate, in comparison with Sample 2 which is the panel of the same shape.

Third Embodiment

In the panel 11 of which face portion 12 has the flat outer surface 12*b* and the curved inner surface 12*a*, as described in the first and second embodiments, the thickness of the panel 11 at the center of the face portion 12 widely differs from that at the edges of the face portion 12, resulting in a difference in light transmittance. Accordingly, in the image displayed on the phosphor screen, the light transmittance at the center differs from that at the edges, resulting in variety of brightness throughout the screen. Especially, a difference between the brightness at the center and that at the edges significantly affects a perceived depth of the image, which affects the perceived flatness of the image.

Figure 5:
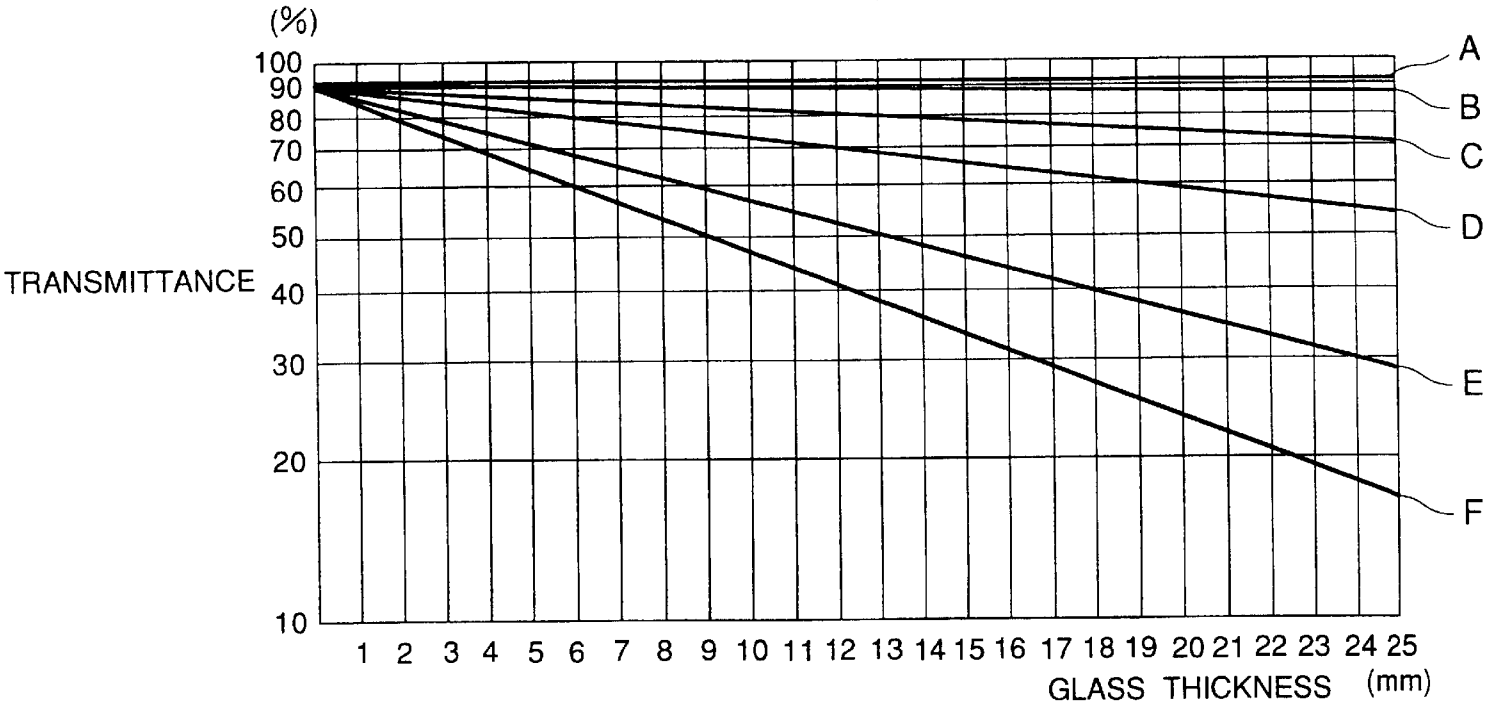
FIG. 5 shows transmittance characteristic of glass materials of a color CRT panel according to a third embodiment of the present invention.

The glass materials currently used for color CRT panels include A, B, C, D, E and F shown in FIG. 5. A plate of glass material E, which is used for most panels, shows a transmittance of about 52% when the thickness is 12 [mm]. If the inner surface of the panel made from this material is curved to increase its thickness by 4 [mm] at the edges, for example, the transmittance at the edges is about 43%. The ratio of transmittance at the center to that at the edges is therefore about 100:82. As a result, uniformity in brightness throughout the whole screen is deteriorated.

The deterioration of uniformity in brightness, or the difference between the brightness at the center and that at the edges, due to the difference between the thickness of the glass plate at the center and that at the edges can be reduced by increasing the transmittance of the glass material used for the panel. In the commercially available glass panels, a ratio of brightness at the edges to that at the center of the screen is currently 85% or higher. A glass material having such transmittance that brings the ratio of the brightness at the edges to that at the center of the screen to 85% or higher should be used for the glass plate in which the thickness at the edges is greater than that at the center.

Generally, the transmittance T [%] of glass is defined as follows:

$$T=(1-R)^2*e^{kt}*100$$

where R denotes a reflectivity of the glass, k denotes an absorption coefficient, and t is the thickness of the glass. Therefore, a glass material that satisfies the following condition should be used:

$$\frac{(1-R)^2*e^{kt_1}*100}{(1-R)^2*e^{kt_0}*100} \geq 0.85$$

where $t_0$ denotes a thickness of the face portion 12 at the center of the screen, and $t_1$ denotes a thickness of the face portion 12 at the edges of the screen. If a glass material characterized by R=0.045 and k=0.00578 is used, for example, a glass plate which is 12 [mm] thick at the center and 16 [mm] thick at the edges can satisfy the condition indicated above.

As described above, the panel of which face portion has the flat outer surface and the curved inner surface has the difference between the transmittance at the center and that at the edges, which is caused by the variation in the thickness of the glass. By forming the panel from the glass material with a high transmittance that satisfies the condition indicated above, the effect of the variation in the thickness can be reduced and the difference in the transmittance is almost eliminated throughout the screen.

Except for the above points, the color CRT panel according to the third embodiment is the same as that according to the first or second embodiment.

Fourth Embodiment

Using a glass material with a high transmittance for the panel causes reflection of external light on the phosphor screen to increase, thereby degrading the contrast, which is an important characteristic of the color CRTs used for displays. The color CRT formed as has been described in the third embodiment can keep the difference between the brightness at the center and that at the edges within a permissible range if the panel has a transmittance of 60% or higher. This color CRT, however, has low contrast.

Figure 6:
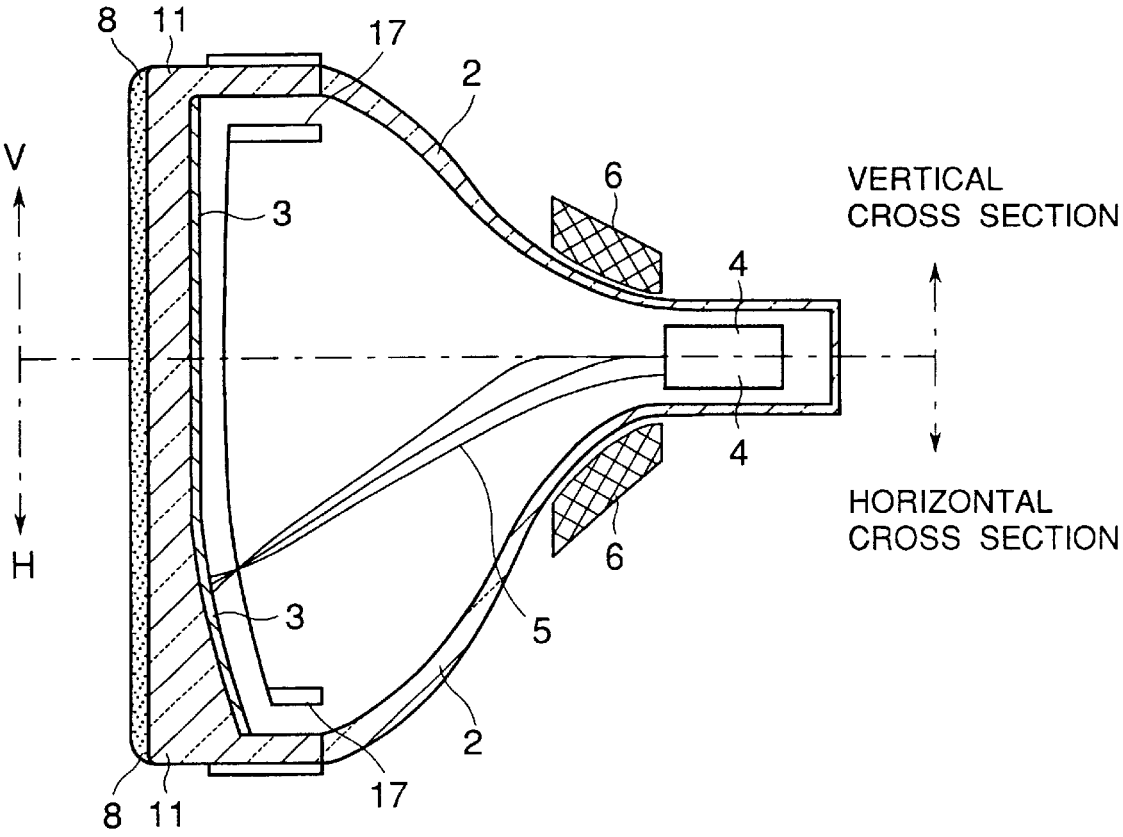
FIG. 6 shows cross sections of a color CRT using a color CRT panel according to a fourth embodiment of the present invention.

Generally, the color CRT panel formed as has been described in the first embodiment must have a transmittance of 60% or above, when the screen size and the viewing distance are taken into consideration. On the other hand, sufficient contrast can be maintained when the transmittance of the panel ranges from 30% to 60%. Therefore, an overall transmittance can be kept within the range of 30% to 60% and sufficient contrast can be kept by using a glass material with a transmittance of 60% or above and providing the surface of the panel 11 with a surface treatment film 8 having a transmittance of about 50% to 90%, as shown in FIG. 6.

The surface treatment film 8 on the panel 11 can be performed by the following methods: a film adhesion method in which a base film provided with a light absorption layer, antistatic layer, antireflection layer and the like is disposed on the surface of the panel 11 of the color CRT; a wet coating method in which a light absorption layer and the like are formed by coating the surface of the panel 11 of the CRT with a liquid mixture of an organic or inorganic base coat and an organic or inorganic pigment or dye, through spin coating or spraying; and a dry coating method in which a light absorption layer and the like are directly deposited on the surface of the panel 11 of the CRT by coating through vacuum evaporation and the like.

As has been described above, if the material with the high transmittance is used for the panel, the contrast would be degraded, but the contrast is improved by optimizing the overall transmittance through the surface treatment film 8. Accordingly, the color CRT that reproduces a high quality image which is perceived as being flat without difference in brightness can be provided.

Further, the surface treatment film 8 can also be provided on the color CRT panel according to the first, second or third embodiment.

Fifth Embodiment

Figure 10A:
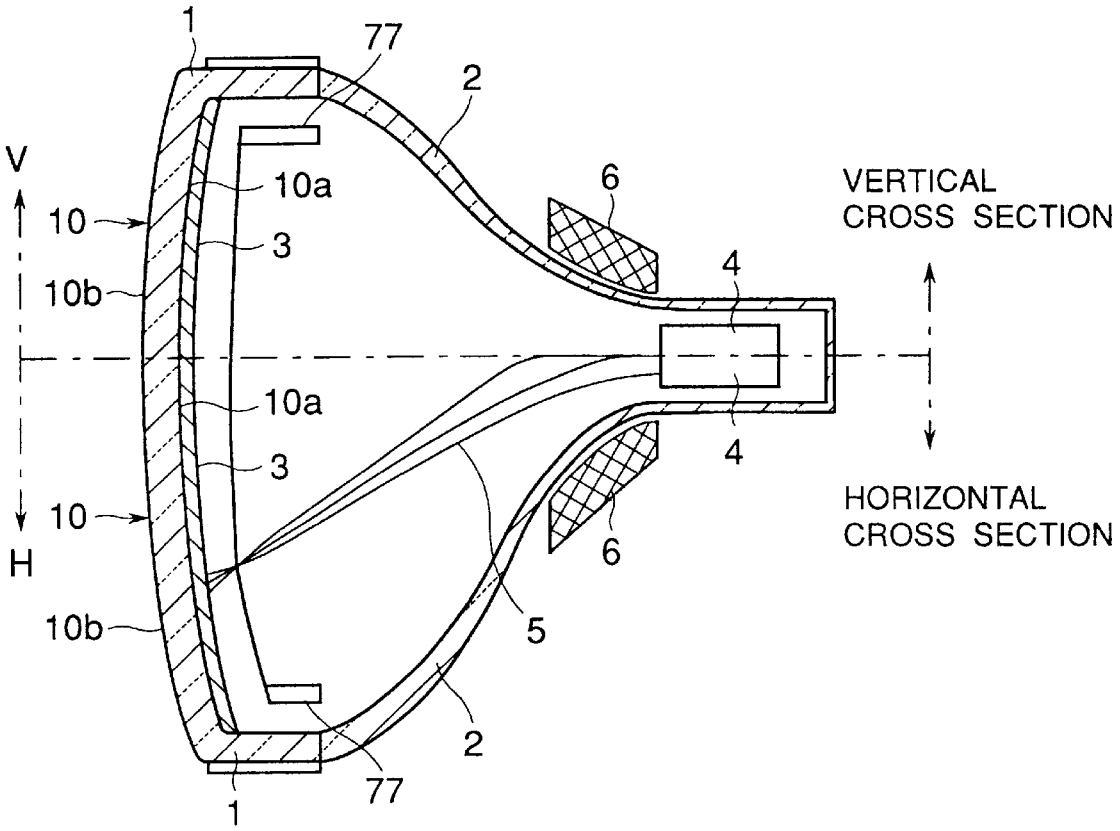
FIG.10A CONVENTIONAL ART
FIG. 10A and FIG. 10B show cross sections and a perspective view of another color CRT using a conventional color CRT panel.
Figure 10B:
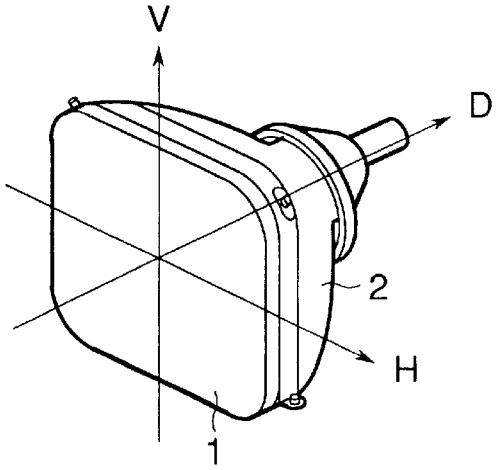
FIG.10B CONVENTIONAL ART
Figure 11:
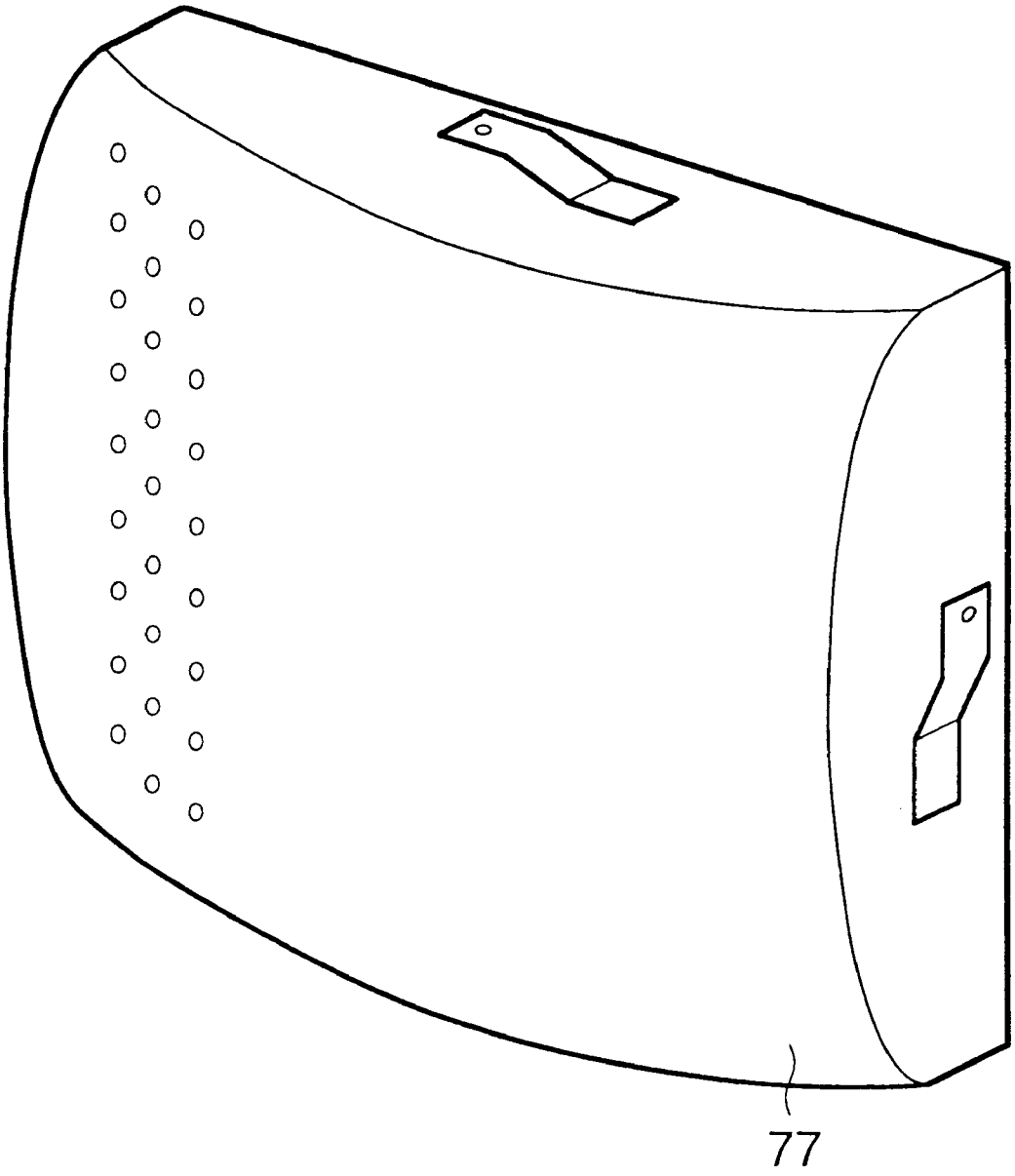
FIG.11 CONVENTIONAL ART
FIG. 11 shows a perspective view of a pressed shadowmask of FIG. 10A.

The above-described first embodiment pertains to the color CRT with the tensioned shadow-mask formed to be almost flat in the direction of the vertical axis of the screen and curved in the direction of the horizontal axis. The color CRT (FIG. 10A) using the pressed shadow-mask formed to be curved in the directions of the vertical and horizontal axes of the screen as shown in FIG. 11 can produce the similar effect.

Figure 7A:
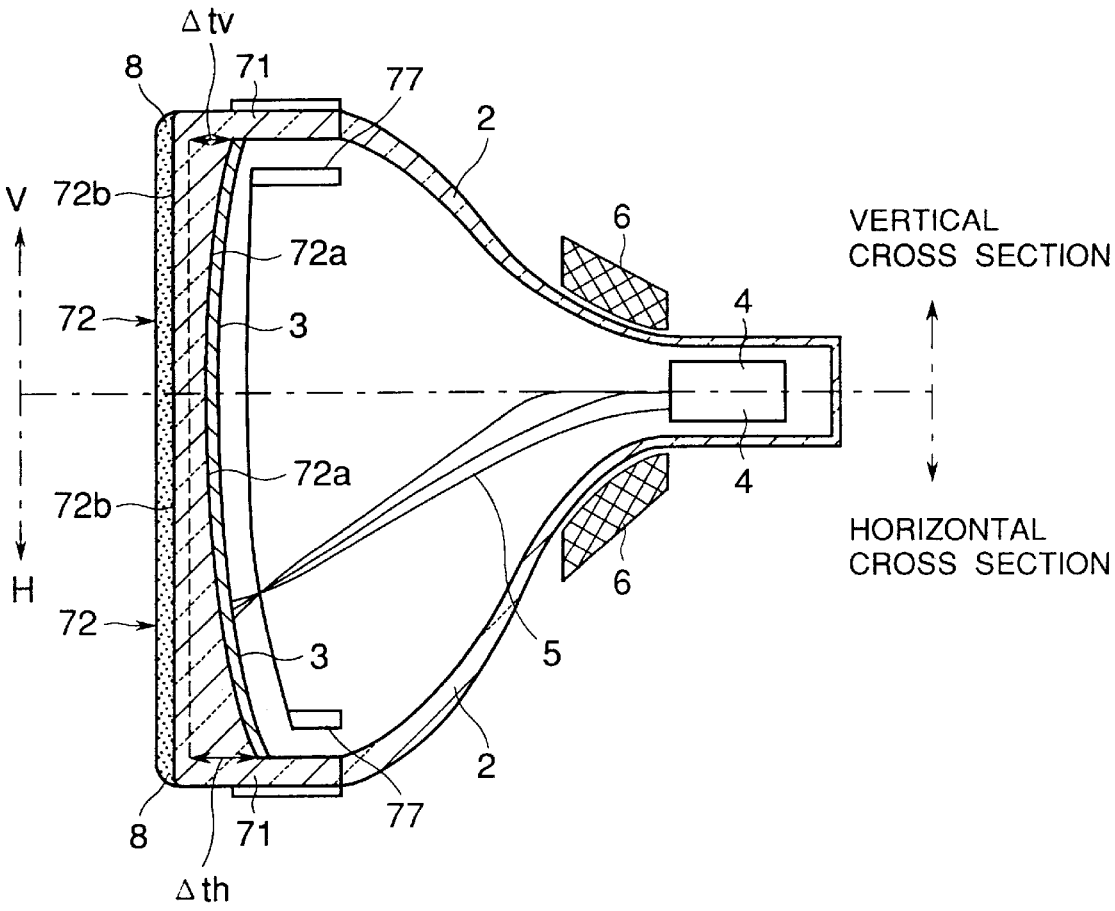
FIG. 7A and FIG. 7B show cross sections and a perspective view of a color CRT using a color CRT panel according to a fifth embodiment of the present invention.
Figure 7B:
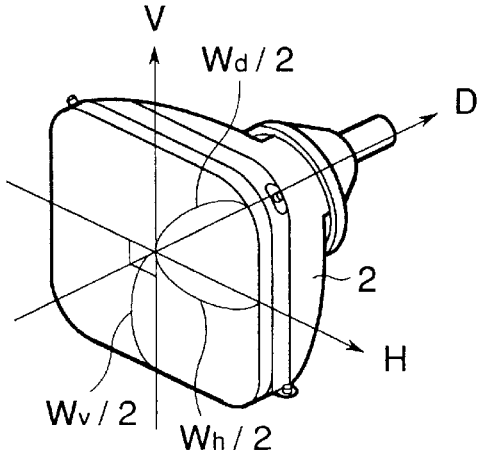
Figure 8:
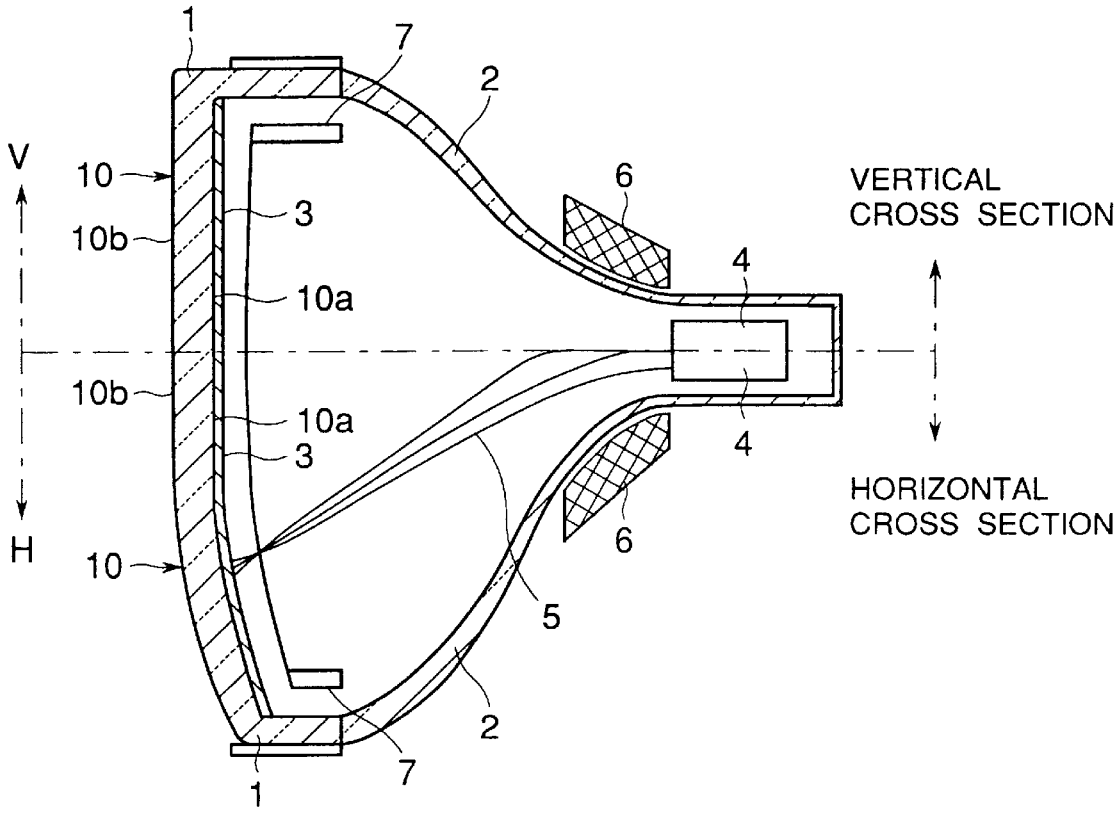
FIG.8 CONVENTIONAL ART
FIG. 8 shows cross sections of a conventional color CRT.
Figure 9:
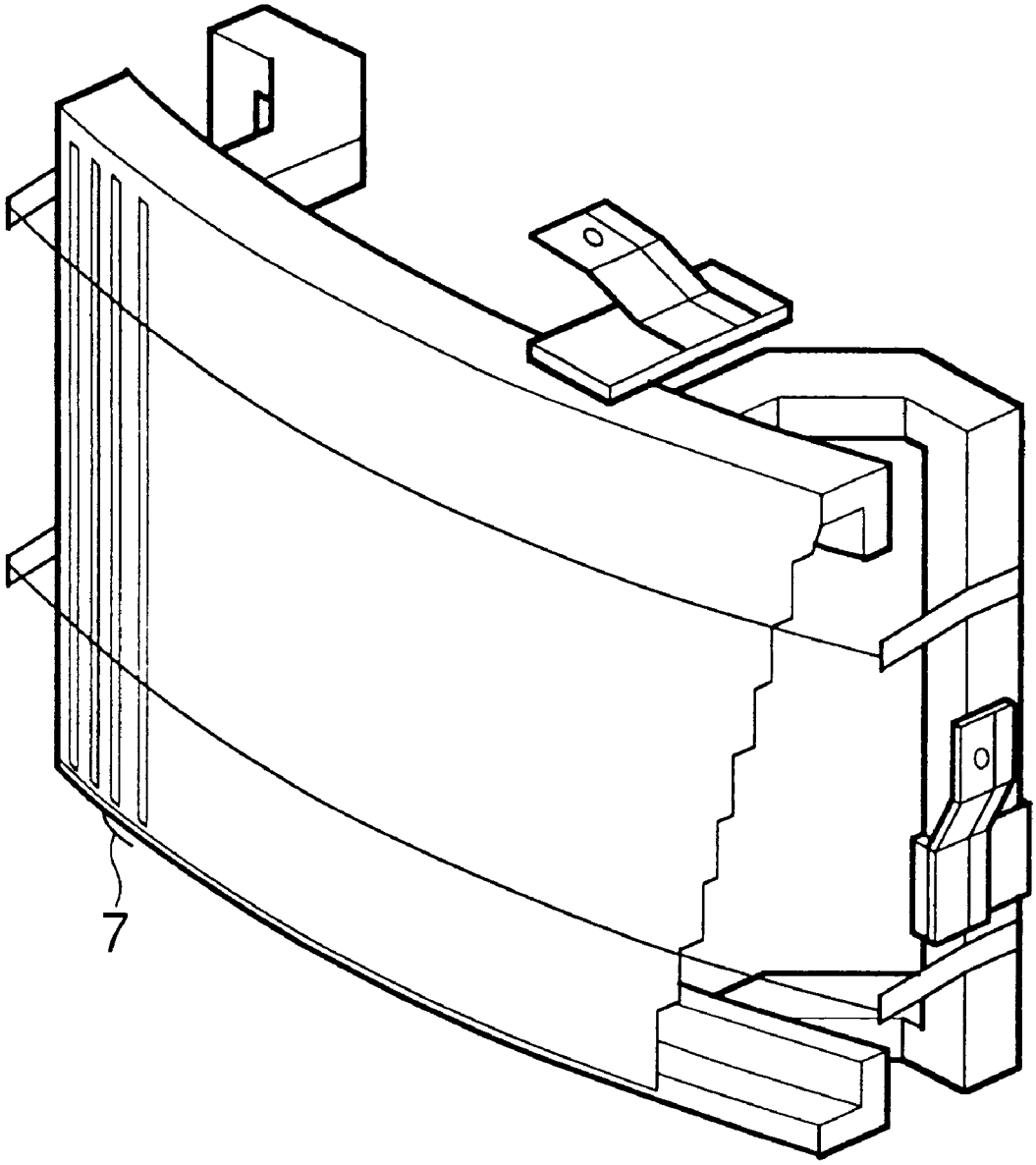
FIG.9 CONVENTIONAL ART
FIG. 9 shows a perspective view of a tensioned shadowmask of FIG. 8.

That is, as shown in FIG. 7A and FIG. 7B, the color CRT may have the panel 71 which is formed to have a substantially flat outer surface 72*b* and an inner surface 72*a* concavely curved with predetermined radius of curvature in the direction of the vertical axis V as in the direction of the horizontal axis H in the similar manner to the first embodiment, a predetermined radius of curvature in the direction of the vertical axis V, and a predetermined radius of curvature in the direction of the diagonal axis D. The floating distance is calculated and the inner surface 72*a* is formed so as to compensate for the floating distance, that is, a radius of curvature $R_x$ of the inner surface 72*a* of the panel 71 in the direction of the horizontal axis H is substantially expressed as $$R_x \le \frac{\left(\frac{W_h}{2}\right)^2 + \Delta t_h^2}{2 * \Delta t_h}$$

$$\Delta t_h = t * \left[1 - \frac{\cos^2\theta_{2h}}{n_1 - \frac{1}{n_1} * \sin^2\theta_{2h}}\right]$$

$$\theta_{2h} = \tan^{-1}\left(\frac{W_h}{2 * L}\right)$$

where $W_h$ denotes a horizontal width of an effective area of picture in the face portion, L denotes an optimum viewing distance, $n_1$ denotes a refractive index of the face portion 72, and t denotes a thickness of the face portion 72 at a center of the face portion 72.

Further, the inner surface is concavely curved with a radius of curvature $R_y$ in a direction of a vertical axis of the cathode ray tube, and the following conditions are satisfied:

$$R_y \le \frac{\left(\frac{W_v}{2}\right)^2 + \Delta t_v^2}{2 * \Delta t_v}$$

$$\Delta t_v = t * \left[1 - \frac{\cos^2\theta_{2v}}{n_1 - \frac{1}{n_1} * \sin^2\theta_{2v}}\right]$$

$$\theta_{2v} = \tan^{-1}\left(\frac{W_v}{2 * L}\right)$$

where $W_v$ denotes a vertical width of the effective area of picture

In addition, the inner surface is concavely curved with a radius of curvature $R_d$ in a direction of a diagonal axis of the cathode ray tube, and the following conditions are satisfied:

$$R_d \le \frac{\left(\frac{W_d}{2}\right)^2 + \Delta t_d^2}{2 * \Delta t_d}$$

$$\Delta t_d = t * \left[1 - \frac{\cos^2\theta_{2d}}{n_1 - \frac{1}{n_1} * \sin^2\theta_{2d}}\right]$$

$$\theta_{2d} = \tan^{-1}\left(\frac{W_d}{2 * L}\right)$$

where $W_d$ denotes a diagonal width of the effective area of picture.

As described in the first embodiment, due to the human eyes characteristic, the depth in the horizontal direction is hard to be perceived. So, if the radius of curvature in the direction of the vertical axis is determined in the consideration of formability of the pressed shadow-mask, the effect of the present invention is not eliminated.

As has been described above, the color CRT according to the present invention uses the panel which is flat on its outer surface and curved on its inner surface with such curvature that produces the perceptible flatness. The display image can be visually perceived as being flat.

Further, in the CRT using the pressed shadow-mask, without using a special shadow-mask, the display image can be visually perceived as being flat.

Furthermore, the color CRT panel according to the fifth embodiment can also be provided with the compressive stress layers in the second embodiment and/or the surface treatment film in the fourth embodiment. In addition, the color CRT panel according to the fifth embodiment can also be satisfied with the condition regarding the transmittance in the third embodiment.

What is claimed is:

1. A color cathode ray tube panel comprising:

a glass face portion including a substantially flat outer surface facing a viewer and an inner surface on which a phosphor screen is coated;

wherein the inner surface is concavely curved with a radius of curvature $R_x$ in a direction of a horizontal axis of the cathode ray tube, and the following conditions are satisfied:

$$R_x \leq \frac{\left(\frac{W_h}{2}\right)^2 + \Delta t_h^2}{2 * \Delta t_h}$$

$$\Delta t_h = t * \left(1 - \frac{\cos^2\theta_{2h}}{n_1 - \frac{1}{n_1} * \sin^2\theta_{2h}}\right)$$

$$\theta_{2h} = \tan^{-1}\left(\frac{W_h}{2 * L}\right)$$

where $W_h$ denotes a horizontal width of an effective area of picture in said face portion, L denotes an optimum viewing distance, $n_1$ denotes a refractive index of said face portion, t denotes a thickness at a center of said face portion, and $\Delta t_h$ represents a floating distortion factor associated with the thickness along the horizontal axis.

2. A color cathode ray tube panel of claim 1, wherein a cross section of the inner surface in a direction of a vertical axis perpendicular to the horizontal axis is straight.

3. A color cathode ray tube panel of claim 1, wherein the inner surface is concavely curved with a radius of curvature $R_y$ in a direction of a vertical axis perpendicular to the horizontal axis, and the following conditions are satisfied:

$$R_y \leq \frac{\left(\frac{W_v}{2}\right)^2 + \Delta t_v^2}{2 * \Delta t_v}$$

-continued $$\Delta t_v = t * \left(1 - \frac{\cos^2\theta_{2v}}{n_1 - \frac{1}{n_1} * \sin^2\theta_v}\right)$$

$$\theta_{2v} = \tan^{-1}\left(\frac{W_v}{2 * L}\right)$$

where $W_v$ denotes a vertical width of the effective area of picture $\Delta t_v$ represents a floating distortion factor associated with the thickness along the vertical axis; and the inner surface is concavely curved with a radius of curvature $R_d$ in a direction of a diagonal axis of the cathode ray tube, and the following conditions are satisfied:

$$R_d \leq \frac{\left(\frac{W_d}{2}\right)^2 + \Delta t_d^2}{2 * \Delta t_d}$$

$$\Delta t_d = t * \left(1 - \frac{\cos^2\theta_{2d}}{n_1 - \frac{1}{n_1} * \sin^2\theta_d}\right)$$

$$\theta_{2d} = \tan^{-1}\left(\frac{W_d}{2 * L}\right)$$

where $W_d$ denotes a diagonal width of the effective area of picture, and $\Delta t_d$ represents a floating distortion associated with the thickness along the diagonal axis.

4. The color cathode ray tube panel of claim 1, wherein said face portion includes compressive stress layers each formed under the outer surface and the inner surface.

5. The color cathode ray tube panel of claim 4, wherein a condition 1000 [psi]$\leqq\sigma_c\leqq$2000 [psi] is satisfied, where $\sigma_c$ denotes a value of stress generated in the compressive stress layers.

6. The color cathode ray tube panel of claim 1, wherein a transmittance of glass material of said face portion ranges as indicated below:

$$\frac{(1-R)^2 * e^{kt_1} * 100}{(1-R)^2 * e^{kt_0} * 100} \geq 0.85$$

where R denotes a reflectivity of the glass material, k denotes an absorption coefficient of the glass material, $t_0$ denotes a thickness of said face portion at a center thereof, and $t_1$ denotes a thickness of said face portion at an edge thereof.

7. The color cathode ray tube panel of claim 6, further comprising a surface treatment film having a transmittance ranging from 50% to 90% on said face portion using such glass material that offers a transmittance of 60% or higher, so that an overall transmittance of said face portion and said surface treatment film ranges from 30% to 60%.

* * * * *